US005921059A

United States Patent [19]

Farra

[11] Patent Number: 5,921,059

[45] Date of Patent: Jul. 13, 1999

[54] DOOR FIT FOR A HOLLOW CORE PANEL DOOR

[76] Inventor: Douglas N. Farra, 419 Ely Harmony Rd., Freehold, N.J. 07728

[21] Appl. No.: 09/036,953

[22] Filed: Mar. 9, 1998

[51] Int. Cl.[6] ..... E04C 2/38; E06B 3/00

[52] U.S. Cl. ..... 52/800.13; 52/716.8; 52/717.01; 52/730.3; 52/784.1; 52/800.17; 52/801.1

[58] Field of Search ..... 52/800.13, 800.17, 52/801.1, 717.01, 784.1, 716.8, 730.3

[56] References Cited

U.S. PATENT DOCUMENTS

| | | | |
|---|---|---|---|
| D. 289,890 | 5/1987 | Adell . | |
| 1,086,934 | 2/1914 | Parish | 52/800.17 |
| 2,752,672 | 7/1956 | Tolman | 52/800.13 X |
| 3,364,645 | 1/1968 | Wenzelberger | 52/800.13 X |
| 3,700,385 | 10/1972 | Sherwood | 52/800.13 X |
| 4,099,765 | 7/1978 | Bright . | |
| 4,513,553 | 4/1985 | Barry . | |
| 4,677,790 | 7/1987 | Adell . | |
| 4,682,442 | 7/1987 | Aldell . | |
| 4,768,320 | 9/1988 | Weller . | |
| 4,803,810 | 2/1989 | Adell . | |
| 5,062,665 | 11/1991 | Schotthoefer . | |
| 5,291,688 | 3/1994 | Pederson | 52/800.13 X |

*Primary Examiner*—Christopher Kent
*Attorney, Agent, or Firm*—Cohen, Pontani, Lieberman & Pavane

[57] ABSTRACT

A door fit mountable in an open end of a modified hollow-core door for providing reinforcement to opposing door facings and preventing warping thereof while providing clearance between the door and a floor. The fit includes a member having a securing device means connected thereto. When positioned in the open end of a modified door, the securing device means, such as tabs or hooks, engage inner surfaces of the modified door.

9 Claims, 2 Drawing Sheets

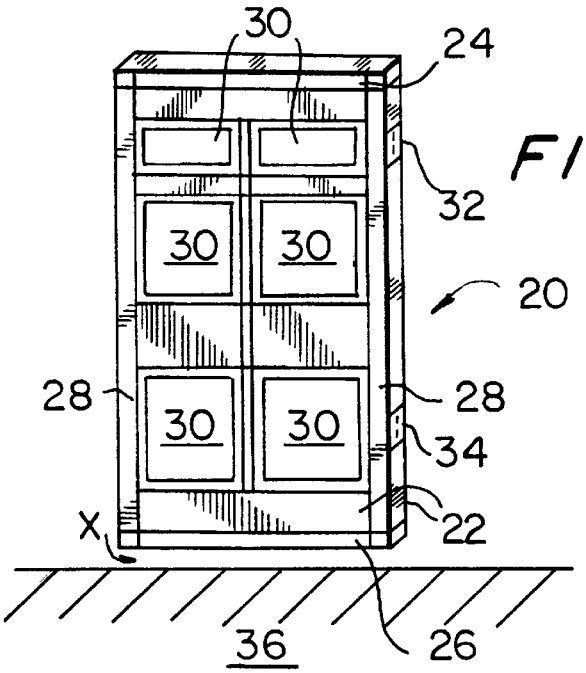
FIG. 1
FIG. 2A
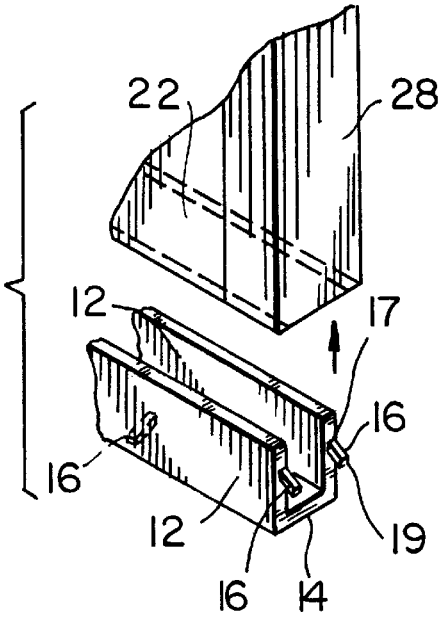
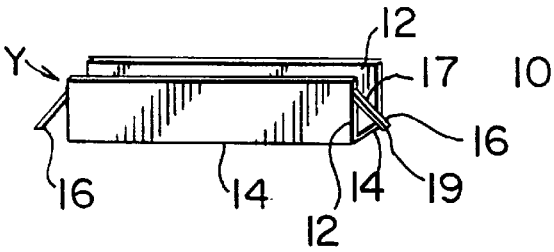
FIG. 2
FIG. 3
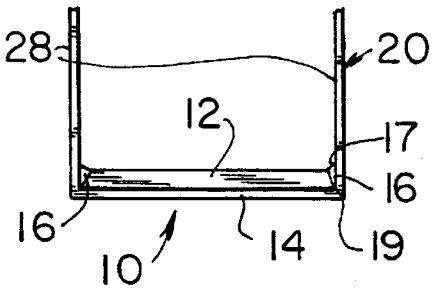
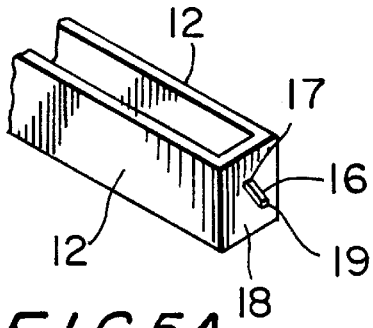
FIG. 5A
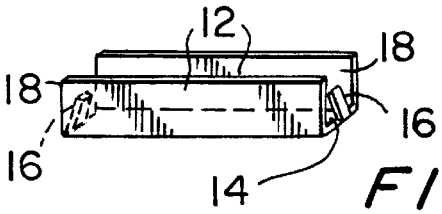
FIG. 5

DOOR FIT FOR A HOLLOW CORE PANEL DOOR

BACKGROUND OF THE INVENTION

I. Field of the Invention

This invention pertains to a fit or shoe for use with a conventional hollow core panel door. More particularly, the present invention pertains to a fit for use in a modified or shortened hollow core panel door.

II. Description of the Related Art

Hollow core panel doors are widely used in interior environments such as residents, offices, etc. The widespread use of such hollow doors is due to their aesthetic appearance as well as their light weight properties and low cost when compared to solid wood doors. Hollow core panel doors are typically constructed with standard height and width dimensions to fit standard doorways. Thus, such doors are typically manufactured with recessed portions in a long edge of the door to accommodate hinge brackets for hingedly fixing such doors to a doorway. When positioned in a standard doorways above a floor, a small clearance of approximately 1 inch is typically provided between the bottom edge of the door and the floor.

When an existing dwelling is modified such as by replacing an existing flooring e.g. by installing carpeting, hardwood floors etc., such modification results in a reduction, and in some cases, removal of the clearance between the floor and the bottom edge of the door. As a result, unless the doors are modified, such as by shortening the doors in height, the doors will become difficult to operate because the bottom of the door will scrape or become impeded by the newly installed flooring.

To avoid this problem, typically the existing doors are shaved down or reduced in height by an amount (for example, by approximately 2 inches) so that the doors can be remounted to tie doorways and, again, have adequate clearance between the bottom of the door and the new floor.

A problem that exists with hollow-ore paneled doors, however, is that when the doors are reduced in height, which is typically accomplished by sawing the bottom edge of the door, the bottom rail of the door which functions to provide support between opposing front and rear door panels to prevent such panels from beveling or flaring out, will no longer be present. As a result, the opposing front and rear door panels will no longer be supported and will tend to flare in or out or warp over time, thereby resulting in a non-aesthetically pleasing modified door.

Accordingly, there exists a need for a door fit or shoe that can be used in a modified panel door to prevent panel beveling or warping.

SUMMARY OF THE INVENTION

A door shoe or fit is provided for use in a modified hollow core panel door for providing reinforcement along a bottom edge of the panel door, thus preventing beveling or warping of opposing front and rear door facings of the door when a bottom rail of the door is removed or modified. The inventive door fit includes a member having a pair of elongated side walls dimensioned for seating within an opening formed along the bottom edge of a modified hollow-core panel door. A bottom surface or panel is connected between the elongated pair of side walls. The fit also includes securing means such as tabs or hooks which are connected to the elongated walls or the side walls and biased outward away from the elongated walls or side walls. The fit is dimensioned for seating in the opening formed on the bottom edge of the modified door. When seated therein, the securing means engages the inner surfaces of either or both of the door facings or side rails and for the outer surface of the door facings and secures the fit in proper position. The securing of the fit can then be reinforced such as by using nails or screws to secure the fit at the bottom edge of the modified door.

In a preferred embodiment, a second pair of elongated side walls which are substantially parallel to the first pair of side walls, is included. The second pair of side walls is attached to the panel. The first and second pairs of side walls are arranged wherein a first wall of the first pair is proximate to a first wall of the second pair, and a second wall of the first pair if proximate a second wall of the second pair, so that a groove or spacing is formed between the first walls and the second walls in which the bottom of each door facing is seated. The securing means is positioned in the grooves to hold the fit in place at the bottom edge of the modified door.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIG. 1 is a front perspective view of a conventional hollow core panel door;

FIG. 2 is a perspective view of a door fit in accordance with the present invention;

FIG. 2A is an exploded perspective view of a portion of a hollow core panel door showing the positioning of the door fit at the bottom thereof;

FIG. 3 is a front perspective view of a door fit positioned in a bottom edge of the door of FIG. 1;

FIG. 5 is an alternative embodiment of the door fit in accordance with the present invention;

FIG. 5A is a perspective view of an alternative embodiment of the door fit of FIG. 2A;

DETAILED DESCRIPTION OF THE PRESENTLY PREFERRED EMBODIMENTS

Figure 4:
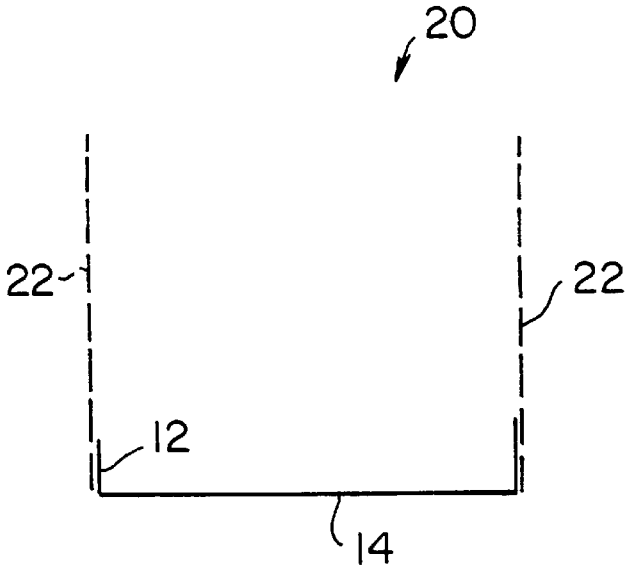
FIG. 4 is a side-plan view of the door fit of FIG. 3.

With reference to FIG. 1, a conventional hollow core panel door 20 is depicted. As shown, door 20 has a pair of door facings 22, (i.e. a front facing and a back facing), a top rail 24, a bottom rail 26 and parallel side rails 28, all of which cooperate with each other to hold a plurality of panels 30 in appropriate position, as is known in the art. Door 20 has a particular height defined by the length of rails 28, and a particular width defined, for example, by the length of bottom and top rails 24, 26. Also as shown, door 20 contains mounting sites 32, 34 for attaching a hinge bracket (not shown) and enabling door 20 to be hingedly secured in a door frame.

When door 20 is mounted in a door frame and above a floor 36 in a known manner, a clearance X is provided which allows for operation of the door without having bottom rail 26 come into contact with floor 36. However, if floor 36 is raised such, for example, as by installing a carpeting or replacement flooring, clearance X will be reduced, thereby causing obstruction of door operation. To alleviate this problem, door 20 is typically shortened in height by, for example, sawing or planing, into and removing bottom rail 26 to provide clearance with floor 36. Once rail 26 is shortened or removed in such a manner, the reinforcement provided by rail 26 to facings 22 will be reduced or removed, thus leaving door facings susceptible to warping or bevelling.

To alleviate this problem, and with reference now to FIGS. 2 and 2A, a door fit in accordance with the present invention is depicted for mounting into a bottom edge of such a modified hollow-core door to provide reinforcement to the door facings 22 and bottom panels 30 while maintaining a clearance between the door 20 and floor 36. Door fit 10 may be constructed of any known durable material, such as metal or wood, and is dimensioned for fitting into or about or over an open bottom edge or cavity formed in a panel door when bottom rail 26 is removed, such as when door 20 is shortened in height. As shown in FIG. 2, fit 10 contains a pair of elongated side-walls 12 connected to each other by a bottom panel 14 in any known manner such as by molding, screwing, etc. Panel 14 is preferably flat and dimensioned for closing off the open edge of the modified door. However, panel 14 can, alternatively, have a "V-shaped" cross-section or any other shaped cross-section so long as it functions for its intended purpose, i.e. to provide support to the door facings 2. A pair of short side-walls 18 may also be included (as shown in FIGS. 5 and 5A) to provide added support between elongated side-walls 12 and panel 14. Short side-walls 18 may be connected to panel 14 and elongated side-walls 12 by molding or screwing.

A securing means 16 is provided to attach and secure fit 10 into the bottom of door 20. The securing means preferably consists of a pair of angled tabs or hooks 16 which are connected either to short side-walls 18 (FIG. 5A) or to the ends of elongated side-walls 12 (FIG. 2A). The securing tabs are positioned so that when fit 10 is placed into a bottom edge of door 20, tabs 16 press against and engage with an inner surface of rails 28 (as shown in FIGS. 2A and 3) and will hold fit 10 in place. As an alternative, securing tabs 16 may be connected to elongated side-walls 12 for engagement with inner edges of door facings 22 or bottom panels 30 when fit 10 is positioned in the bottom edge of door 20 (FIG. 2A).

With reference now to FIGS. 2–5, securing tabs 16 include a first end 17 and a second end 19 and are preferably flexible. As shown, for each tab 16, first end 17 is mounted to an opposite end of either elongated side-walls 12 (as shown in FIG. 2) or to short side-walls 18 (FIG. 5), with the second end 19 of each tab 16 being angled in a direction away from either elongated or short side-walls. As will be appreciated, when fit 10 is positioned at an opened edge of door 20 and pushed into its intended position wherein panel 14 is located at the bottom of facings 22 (as shown in FIG. 4), ends 19 of tabs 16 will be moved to a position flush with short side-walls 18 and will, due to the flexibility of tabs 16, press against an inner surface of rails 28 or facings 22 to hold fit 10 stationary therein. Once in place, fit 10 may be further secured to the bottom of door 20 in any known manner, such as by nails, screws, etc.

Figure 6:
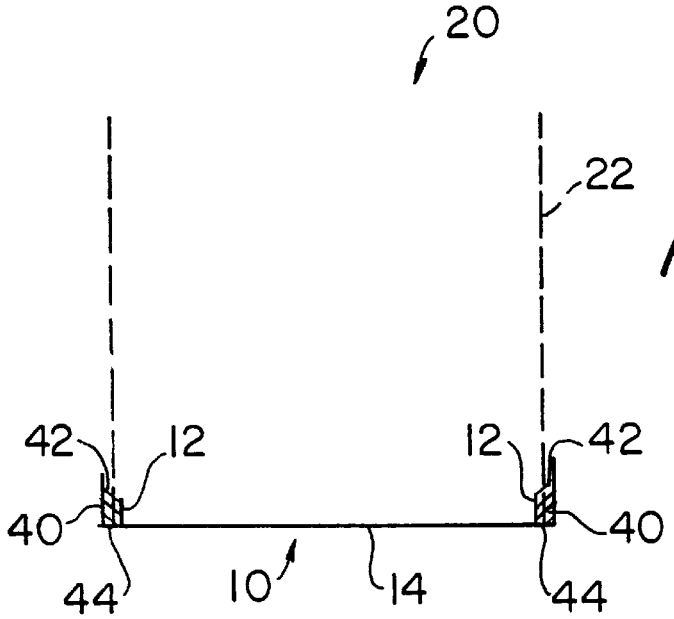
FIG. 6 is another alternative embodiment of the door fit in accordance with the present invention.
Figure 6A:
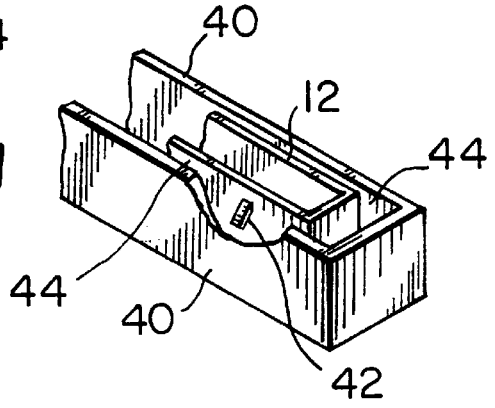
FIG. 6A is a perspective view of the alternative embodiment depicted in FIG. 6.

With reference now to FIGS. 6 and 6A; another embodiment of the present invention is depicted. FIG. 6 shows a side view of fit 10 viewed in the direction of arrow Y of FIG. 2 and FIG. 6A is a perspective view of FIG. 6. As shown, a second pair of elongated side walls 40 are included in fit 10 and are positioned in a substantially parallel and spaced location with respect to elongated side walls 12 so that a channel or groove 44 is formed between the opposing side walls. Groove 44 is dimensioned to accommodate insertion of door facings 22 when the fit 10 is positioned at the bottom edge of the modified door 20. Securing means such as a plurality of hooks, tacks or nails 42 are positioned in groove 44 and engage with facings 22 to provide securerment of fit 10 to door 20.

As discussed above, the embodiment in FIGS. 6 and 6A contain a pair of sidewalls 12, 40 to form a channel 44 for accommodating door facings 22. It will be readily appreciated by those having ordinary skill in the art that the door fit can be constructed with a single pair of sidewalls 40 to seat at the bottom of a hollow-core panel door 20 and be fastened against the outer surface of the door facings 22.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, other securing means may be envisioned by those having ordinary skill in the at such as raised bumps or other protuberances on fit 10 which will engage the modified door rails or facings. Moreover, the securing hooks may be positioned in other locations on fit 10 while still serving their intended function of holding fit 10 in place and providing support to the bottom edge of door 20. It is expressly intended, therefore, that all combinations of those elements which perform substantially the same function in substantially the same way to achieve the same results are within the scope of the invention which is to be limited only as indicated by the scope of the claims appended hereto.

I claim:

1. A door fit for providing reinforcement to an open bottom edge of a modified hollow-core panel door having opposing front and rear facings and side rails, said door fit comprising:

a member having a first pair of substantially parallel elongated walls and a panel connected between said pair of elongated walls, said walls and panel being dimensioned for seating at the open bottom edge of the modified door; and means for securing said member at the open bottom edge when said member is seated at the open bottom edge, said means for securing being engageable with one of the front and rear facings and side rails for providing support to the door and for preventing warping of the front and rear facings.

2. The door fit of claim 1, wherein said panel is integrally formed with said pair of elongated walls.

3. The door fit of claim 1, wherein said means for securing comprises a pair of tabs, each having a first end and a second end, said first ends of said tabs connected to said elongated member walls and said second ends being biased away from said member elongated walls so that when said member is seated at the open bottom edge of the modified door, said second ends of said tabs engage one of the pair of facings and side rails.

4. The door fit of claim 1, further comprising a pair of short walls connected between opposing edges of said pair of elongated walls and said panel.

5. The door fit of claim 4, wherein said means for securing comprises a pair of tabs, each having a first end and a second end, each of said first ends of said tabs connected to one of said short walls, and said second ends being biased away from said short walls so that when said member is seated at the open bottom edge of the modified door, said second ends of said tabs engage one of the pair of facings and side rails.

6. The door fit of claim 5, wherein said member is dimensioned for forming a friction fit with said facings and said rails when positioned at the open bottom edge of the modified door.

7. The door fit of claim 1, wherein said member farther comprises a second pair of elongated walls, each wall in said second pair being connected to an opposite end of said panel and being spaced apart from each wall in said first pair of elongated walls to form a groove between a first wall of said first pair and a first wall of said second pair, and a groove between a second wall of said first pair and a second wall of said second pair, said groove being dimensioned for accommodating insertion of the front and rear door facings.

8. The door fit of claim 7, wherein said means for securing is seated in said groove for engaging the front and rear door facings when said member is seated at the open bottom edge.

9. A door fit for providing reinforcement to an open bottom edge of a modified hollow-core panel door having opposing front and rear facings and side rails, said door fit comprising:

a member having first and second pairs of substantially parallel elongated walls and a panel connected between said first and second pairs, said first pair and said panel being dimensioned for seating at the open bottom edge of the modified door, and said first and second pairs of elongated walls being spaced apart from each other to form a groove between a first wall of said first pair and a first wall of said second pair, and a groove between a second wall of said first pair and a second wall of said second pair, said groove being dimensioned for accommodating insertion of the front and rear door facings; and means positioned in said groove for securing said member into the open bottom edge when said member is seated in the open bottom edge, said means for securing being engageable with one of the front and rear facings for preventing warping of the front and rear facings.

* * * * *